US006190065B1

(12) United States Patent
Brzuskiewicz

(10) Patent No.: US 6,190,065 B1
(45) **Date of Patent: *Feb. 20, 2001**

(54) THERMAL IMAGING TAPE CARTRIDGE

(75) Inventor: John E. Brzuskiewicz, Peoria, AZ (US)

(73) Assignee: Kroy LLC, Scottsdale, AZ (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/049,743

(22) Filed: Mar. 27, 1998

(51) Int. Cl.[7] ..... B41J 2/32
(52) U.S. Cl. ..... 400/120.01; 400/613
(58) Field of Search ..... 400/120.01, 615.2, 400/613, 612, 611, 207, 249

(56) References Cited

U.S. PATENT DOCUMENTS

| | | | | |
|---|---|---|---|---|
| 4,836,697 | * | 6/1989 | Plotnick et al. | 400/615.2 |
| 4,927,278 | * | 5/1990 | Kuzuya et al. | 400/208 |
| 4,983,058 | | 1/1991 | Nagae | 400/249 |
| 5,222,818 | * | 6/1993 | Akiyama et al. | 400/615.2 |
| 5,419,648 | * | 5/1995 | Nagao et al. | 400/208 |
| 5,435,658 | | 7/1995 | Hasegawa | 400/241 |
| 5,494,365 | | 2/1996 | Nagae et al. | 400/703 |
| 5,518,328 | | 5/1996 | Okuchi et al. | 400/208 |
| 5,593,241 | * | 1/1997 | Kawaguchi | 400/613 |
| 5,601,375 | * | 2/1997 | Sims et al. | 400/207 |
| 5,813,773 | | 9/1998 | Kawai | 400/207 |

FOREIGN PATENT DOCUMENTS

| | | | | |
|---|---|---|---|---|
| 467414 | * | 1/1992 | (EP) | 400/613 |
| 403297679 | * | 12/1991 | (JP) | 400/615.2 |

* cited by examiner

*Primary Examiner*—John S. Hilten
*Assistant Examiner*—Anthony H. Nguyen
(74) *Attorney, Agent, or Firm*—Dorsey & Whitney LLP

(57) ABSTRACT

A tape cartridge for use in a thermally printing device of the type having a cartridge receiving cavity, a thermal print head and a platen in which the cartridge includes a cartridge housing, a supply of double sided adhesive laminating tape and a supply of direct thermal imaging tape.

2 Claims, 4 Drawing Sheets

THERMAL IMAGING TAPE CARTRIDGE

BACKGROUND OF THE INVENTION

1. Field of the Art

The present invention relates generally to a thermal imaging tape cartridge for use in a label or strip printer or the like, and more particularly to a thermal imaging tape cartridge having a spool of thermal imaging tape with the view side facing outwardly and a spool of double sided adhesive laminating film for application to the substrate side of the thermal imaging tape.

2. Description of the Prior Art

A great number of supply cartridges exist for use in connection with label or strip printers or the like. These cartridges are exemplified by and disclosed in U.S. Pat. Nos. 4,927,278; 4,983,058 and 5,419,648. These patents all disclose a cartridge housing, a supply of printing or image carrying tape, a supply of ink or transfer ribbon, and a supply of double sided adhesive or laminating tape to be applied between the image carrying tape and the substrate after printing. All of the cartridges disclosed in the above patents are characterized by the existence of an ink or transfer ribbon for transferring a desired image from the ink ribbon to the printing tape.

Supply cartridges also exist which contain a supply of printing tape in which an image is formed directly onto the tape via thermal imaging techniques. This type of cartridge is exemplified by and disclosed in U.S. Pat. Nos. 5,474,968; 5,494,365; 5,518,328, and 5,435,658. In these cartridges, the tape is housed within the cartridge on a spool in which the view side of the tape faces inwardly so as to protect the thermal sensitive portion of the tape from heat or light. The image in these cartridges is also formed right side up on the top or view side of the tape. The tape in such cartridges generally includes a peel off adhesive which enables the printed image carrying tape to be applied to a substrate at a desired position. When this is done, however, the view side of the tape upon which the image is formed is exposed to the environment and normal handling. Thus, it is subject to being scratched, smudged, and simply worn away over time. Although attempts have been made such as in U.S. Pat. No. 5,474,968 to provide a protective layer on the thermal sensitive layer to provide the image layer with protection, there continues to be a need to improve upon this process.

Accordingly, there is a need in the art for a tape supply cartridge having an image carrying tape of the thermal imaging type without the need for an ink transfer ribbon in which the image is provided with improved protection against scratches, abrasions and other normal wear.

SUMMARY OF THE INVENTION

In contrast to the prior art, the present invention relates to a supply cartridge for use with a label or strip printer or the like in which the image receiving tape is of the thermal imaging type and in which the cartridge further includes a double sided adhesive tape for application to the substrate and image carrying side of the image receiving tape. With such a structure, and contrary to the prior art, the image is formed on the thermal imaging tape on the side of the tape opposite the view side. Thus, after formation of the image and application of the double sided adhesive tape, the thermally formed image is viewed from the view side of the image receiving tape through the thickness of the tape. Thus, it is important that the image receiving tape be sufficiently transparent or translucent to allow the image to be viewed through the thickness of such tape.

More specifically, the cartridge in accordance with the present invention, is designed for use with a thermal printing device of the type having a cartridge receiving cavity and a print assembly comprising a print head and a platen in which the print head and platen are movable toward and away from one another between print and non-print positions, respectively. The cartridge includes a housing with a pair of spaced, substantially parallel side walls and an edge wall joined to the side walls and extending along a substantial portion of the peripheral edges of the side walls. A supply of image receiving tape of the thermal imaging type is contained within the housing on a spool. The thermal imaging tape includes a view side which faces away from the center of the spool and a substrate side which faces towards the center of the spool. The substrate side of the tape includes a thermal sensitive coating for thermal imaging when exposed to heat.

The cartridge further includes a spool of double sided adhesive lamination tape. After the image has been thermally formed on the substrate side on the image carrying tape, one adhesive side of the lamination tape is brought into engagement with, and secured to, the substrate side of the image carrying tape over the generated image. Following removal of the tape combination from the cartridge, a peel off layer on the second adhesive side of the lamination tape is removed and the tape combination is applied to a substrate at a desired position.

Accordingly, it is an object of the present invention to provide an improved supply cartridge for use in a strip or label printer or the like in which the image receiving tape is of the thermal imaging type and in which the indicia on the tape are intended for viewing through the tape.

Another object of the present invention is to provide an improved thermal imaging tape which is highly resistant to abrasion, scratches and wear.

Another object of the present invention is to provide a supply cartridge for a strip or label printer or the like housing an image receiving tape and double sided adhesive tape which is simpler in construction and cheaper than cartridges currently available.

These and other objects will become apparent with reference to the drawings, the description of the preferred embodiment and the appended claims.

DESCRIPTION OF THE PREFERRED EMBODIMENT

The present invention relates generally to a tape supply cartridge for use in a strip or label printer of the type described in U.S. Pat. No. 4,927,278. Accordingly, the disclosure and teachings in U.S. Pat. No. 4,927,278 relating to such a printer are incorporated herein by reference. Further, the term "printer" as used herein shall mean a printer of the type disclosed in U.S. Pat. No. 4,927,278 as well as other strip or label printers or the like.

Figure 1:
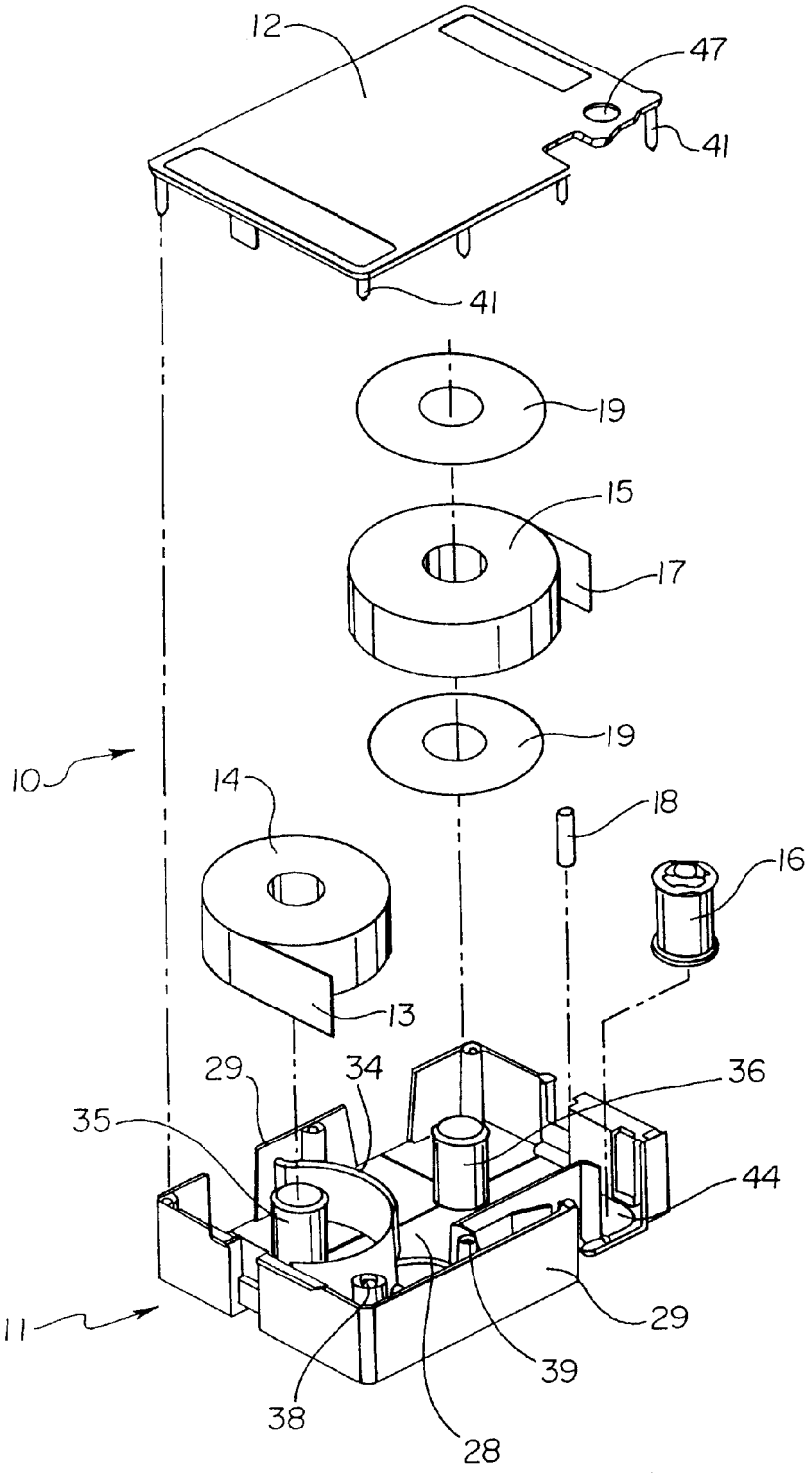
FIG. 1 is an isometric, exploded view of the cartridge of the present invention.
Figure 5:
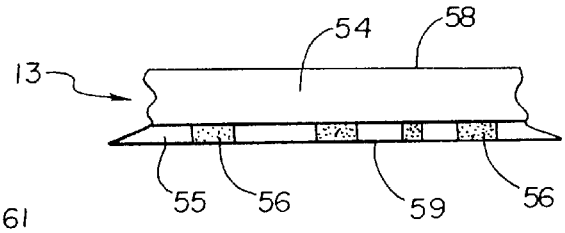
FIG. 5 is a schematic sectional view of the image carrying tape for the cartridge of the present invention.

With reference first to FIG. 1, the cartridge 10 in accordance with the present invention includes a cartridge base 11, a cartridge cover 12 and two spools 14 and 15 of tape supply housed within the cartridge. As described in greater detail below, the spool 14 provides a supply of thermal imaging tape 13 having the general construction as shown in FIG. 5, while the spool 15 provides a supply of double sided adhesive tape 17 having a structure generally illustrated in FIG. 6. The interior of the cartridge 10 also houses a cartridge lamination/advancement roller 16, a guide roller 18 and a pair of antifriction release liner discs 19, 19 positioned on opposite sides of the tape spool 15.

Figure 2:
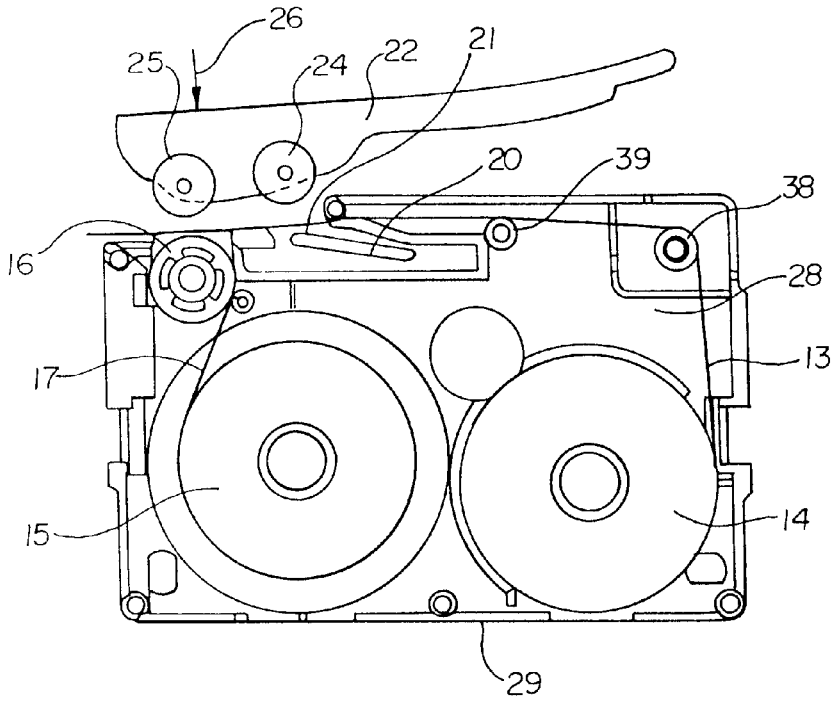
FIG. 2 is a top elevational view of the cartridge in accordance with the present invention with the cover removed and showing the cartridge in relationship to the print head, the platen and the tape advancement roller.

As illustrated in FIG. 2, the supply cartridge of the present invention is designed for use with a printer of the type having a print head 20 and a spring biased platen roller support 22. The print head 20 includes a print head heat source 21 and the roller support 22 carries a platen roller 24 and a roller support advancement/lamination roller. The rollers 24 and 25 are rotatably secured to the arm 22 at their centers. During a printing operation, the arm 22 and the rollers 24 and 25 are moved in the direction of the arrow 26 so that the platen roller 24 moves into printing registration with the heat source 21 on the print head 20 and the roller 25 moves into advancement and lamination registration with the roller 16.

Figure 3:
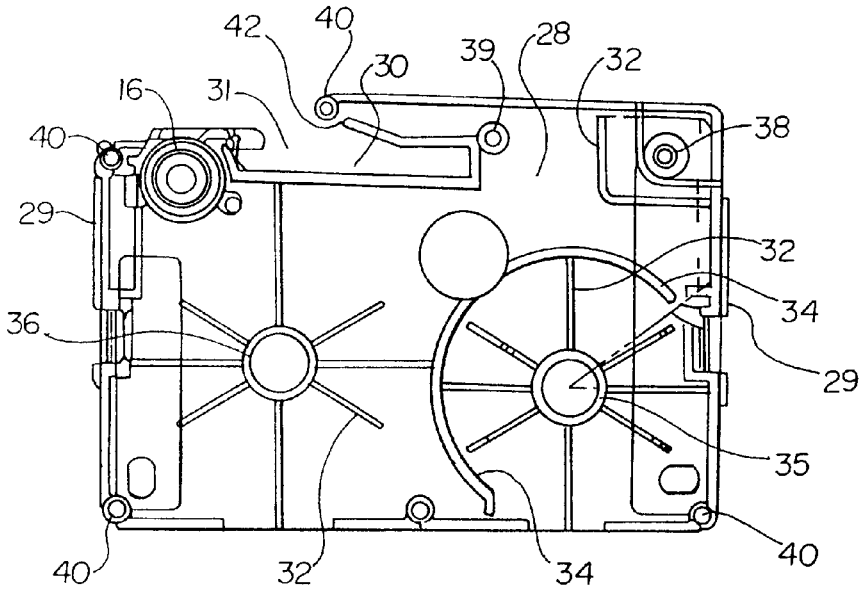
FIG. 3 is a top elevational view of the cartridge base with the tape supplies removed and with the cartridge cover removed.

With continuing reference to FIGS. 1 and 2 and more specific reference to FIG. 3, the cartridge base includes a bottom wall 28 which forms a side wall of the cartridge, and an edge wall 29. The edge wall 29 extends substantially around the entire peripheral edge of the bottom wall 28 and upwardly or outwardly from the bottom wall 28 at substantially right angles as best shown in FIG. 1.

The bottom wall 28 and edge wall 29 are provided with a print head access opening 30 and a platen roller access opening 31. The interior surface of the bottom wall 28 is provided with a plurality of ribs 32 which are raised slightly above the generally planar interior surface of the bottom wall 28. The ribs 32 function to support the tape spools 14 and 15 and to support and guide the tapes 13 and 17 as they travel through the cartridge from the spools to the print head and/or the roller 16 and then out of the cartridge. The interior of the cartridge, and particularly the interior of the cartridge base 11 is also provided with retaining wall sections extending upwardly and outwardly at right angles from the planar surface of the bottom wall 28 to contain the tape spool 14 within the cartridge. The cartridge is also provided with an image tape spool post 35 and an adhesive tape spool post 26 for rotatably supporting the image tape spool 14 and the adhesive tape spool 15, respectively.

The interior of the cartridge is also provided with a pair of tape guide posts 38 and 39 for guiding the image carrying tape 13 from the spool 14 through the cartridge and a guide roller 18 for assisting the movement of the doubled sided adhesive tape 17 from the spool 15 to the advancement/lamination roller 16. The top portion of the edge wall 29 is provided with a plurality of connection openings 40 for receiving corresponding connection posts 41 extending from the inner, planar surface of the cover 12.

A roller access opening 44 (FIG. 1) is provided in the bottom surface of the wall 28 in the area of the roller 16 to provide driving access to the roller 16 from the printer as will be described in greater detail below. The edge wall 29 is also provided with a tape outlet opening 42 in the area of the print head and platen roller access openings 30 and 31 to enable the image carrying tape 13 to exit the cartridge, and move past the print station and to the advancement/lamination roller 16.

Figure 4:
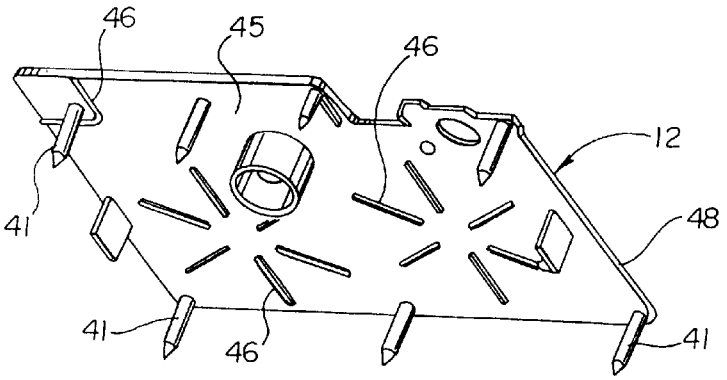
FIG. 4 is an isometric view showing the bottom and two side edges of the cartridge cover.

With continuing reference to FIG. 1 and more specific reference to FIG. 4 showing the cartridge cover from a view inside the cartridge, the cartridge cover 12 includes a top wall 45 which forms a cartridge side wall when the components are assembled into a cartridge. The bottom or inner surface of the wall 45 is generally planar and is provided with a plurality of raised rib members 46 corresponding substantially to the ribs 32 (FIG. 2) of the cartridge base 11. The ribs 46, like the ribs 32, function to support and position the tape spools 14 and 15 within the cartridge and to assist in guiding movement of the tape supplies 13 and 17 from the spools to the printing station and/or the alignment/lamination roller 16. The bottom or inside surface of the wall 49 is provided with a plurality of alignment or connection posts 41 which extend from the inner surface of the wall 45 at substantially right angles. The posts 41 are positioned to be in alignment with the connection openings 40 when the cartridge cover 12 is fixed to the cartridge base 11. This connection may be a press fit or, if desired, can be sonically welded or otherwise secured with an adhesive. The cartridge cover 12 further includes a peripheral edge portion which substantially conforms in size and configuration to the periphery of the edge wall 29 of the cartridge base 11.

Figure 7:
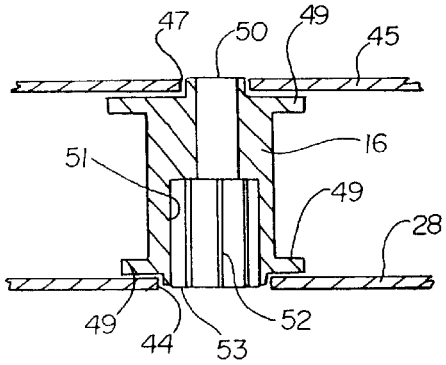
FIG. 7 is a view, partially in section, as viewed along the section line 7—7 of FIG. 2.
Figure 8:
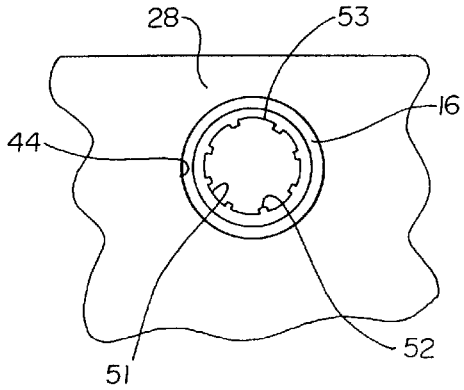
FIG. 8 is a bottom elevational view of the cartridge bottom in the area of the lamination roller.

The specific structure and position of the roller 16 relative to the cartridge is shown best in FIGS. 7 and 8. As shown, the roller 16 includes a pair flanges 49,49 to assist in guiding the tapes 13 and 17 into overlapping position with one another. The existence of the flanges 49,49, however, are optional and, if desired, can be deleted. The top end of the roller 16 is provided with a circular portion extending upwardly through the top wall 45 and is retained therein in the roller guide opening 47. The bottom end of the roller is similarly provided with a downwardly extending portion positioned in the roller access hole 44 in the wall 28. The bottom half of the roller 16 includes a hollow interior 51 provided with a plurality of internal ribs 52. The ribs 52 and the hollow interior 51 are designed to provide access to and driving engagement with a drive spindle or other drive mechanism in the printer.

The imaging receiving tape 13 which is used in connection with the cartridge of the present invention is of the direct thermal imaging type. In other words, an image is formed on such tape as the result of the application of heat to one thermally sensitized surface thereof. This is in direct contrast to image receiving tapes in which images are transferred to the tape as a result of the application of heat or pressure to an ink transfer ribbon or the like. The image receiving tape in accordances with the cartridge in the present invention is shown schematically in FIG. 5. In general, any thermal direct image tape may be used in the cartridge of the present invention provided it is sufficiently transparent or translucent to permit the image formed on the thermally sensitive surface to be viewed through the thickness of the image receiving tape. Further, the image receiving tape 13 must have a view side and a substrate side with the thermally sensitive characteristics applied to the substrate side. In the preferred embodiment, the view side of the image receiving tape is that side of the tape which is intended to be viewed by the observer after imaging has occurred and after the tape has been applied to the desired substrate. The substrate side is intended to be that side of the image receiving tape which is intended to face the substrate when the tape is applied thereto.

With reference to FIG. 5, the image receiving tape 13 is a direct thermal imaging tape having a base film layer 54 and a thermal coating 55 comprised of a thermally sensitive material applied to one surface of the base film 54. In the preferred embodiment, the base film 54 together with the thermal coating provides a substantially transparent or translucent material through which images can be viewed. The thermal coating can be comprised of disbursed leuco dye and an activator or any other thermally sensitive material known in the art. The thermally sensitive material causes a color change to occur in the layer 55 whenever such layer is exposed to a certain threshold level of heat. In such case, the change in color results in the formation of an image 56 within the layer 55.

The image receiving tape 13 of the present invention includes first and second sides comprised of a view side 58 and a substrate side 59. The view side is the side of the tape 13 from which the tape is intended to be viewed after it has been removed from the cartridge and applied to a substrate. The substrate side 59 of the tape 13 is intended to be that side of the tape which faces the substrate when applied to such substrate. In the preferred embodiment, the thermally sensitive material layer 55 is required to be on the substrate side of the tape 13.

Figure 6:
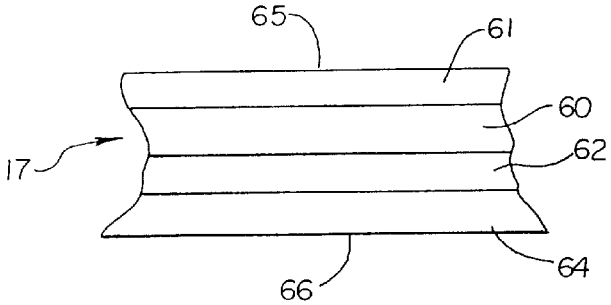
FIG. 6 is a schematic sectional view of the double sided adhesive tape for the cartridge of the present invention.

The tape 17 contained within the cartridge of the present invention is a double-sided adhesive tape whose specific structure is illustrated schematically in FIG. 6. Specifically, the tape 17 includes a primary substrate layer 60 comprised of a paper or film. The primary substrate layer 60 may be opaque, transparent or translucent. The layer 60 may also be clear or provided with a color. One surface of the layer 60 is provided with an exposed adhesive 61 while the opposite surface of the layer 60 is provided with an adhesive layer 62 coupled with a release liner layer 64. The release liner layer 64 is constructed such that it can be easily stripped or removed from the adhesive layer 62 to expose the layer 62, when desired. Accordingly, the tape 17 may be characterized as a double-sided adhesive tape having a first adhesive side comprised of the exposed adhesive layer 61 and a second adhesive side with a release liner comprised of the adhesive surface 62 and the release liner 64.

The operation of the cartridge of the present invention and the travel path and orientation of the tapes 13 and 17 within the cartridge can be understood best with reference to FIG. 2.

Figure 9:
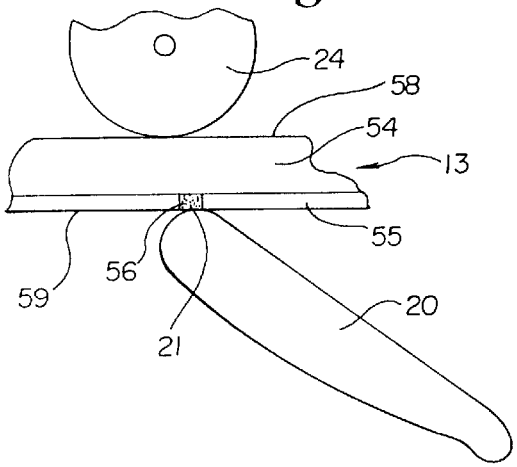
FIG. 9 is an enlarged view showing the relationship between the tape, platen roller and print head and the formation of a thermal image.

When in its wound state as shown in FIG. 2, the tape 13 is wound onto the spool 14 so that the substrate side faces inwardly toward the spool 14. Upon leaving the spool, the tape 13 passes over the guideposts 38 and 39, out through the opening 42 (FIG. 3) and into an image-forming position relative to the print head 20 and the platen roller 24. As shown best in FIG. 9, the tape 13 passes between the print head 20 and platen roller 24 with the substrate side 59 of the tape facing the print head 20 and in particular the heat generating portion 21 of the print head 20. The view side 58 of the tape 13 faces the platen roller 24. When the thermal generating portion 21 of print head 20 is energized, the heat forms an image 56 in the thermally sensitive layer of the tape 13.

Figure 10:
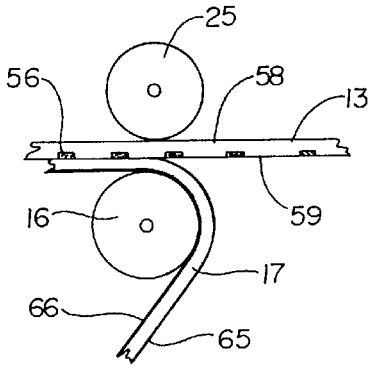
FIG. 10 is an enlarged view showing the relationship between the image receiving tape and the double adhesive tape in the area of the advancement/lamination roller.

From the print station defined by the print head 20 and the platen roller 24, the tape 13 extends to the advancement/lamination roller 16. As shown best in FIG. 10, the substrate side 59 of the tape 13 faces the roller 16 and is exposed to the exposed adhesive side 65 of the tape 17. The lamination tape 17 is mounted on the spool in accordance with the preferred embodiment with the exposed adhesive side 65 facing inwardly relative to the spool. Thus, as it extends up to the roller 16, the release liner side 66 faces the roller 16, with the exposed adhesive side 65 facing away from the roller 16 and toward the substrate side 59 of the tape 13.

Thus, as the tapes 13 and 17 pass between the rollers 16 and 25, the tapes 13 and 17 are laminated to one another, with the images 56 on the tape 13 protected from any abrasion, scratching, or the like, from its view side by the thickness of the tape 13 itself. After the laminated tape has been removed from the cartridge, it can be applied to a substrate by removing the release liner 64 from the side 66 of the laminated tape and positioning the printed tape at a desired position. Because the direct thermal imaging tape is transparent or translucent, the images 56 can be viewed from the view side 58 through the thickness of the tape 13.

Although the preferred embodiment of the present invention has been described in detail, it is contemplated that various modifications could be made to the preferred embodiment without deviating from the spirit of the present invention. Accordingly, it is intended that the scope of the present invention be dictated by the appended claims rather than by the description of the preferred embodiment.

What is claimed is:

1. A tape supply cartridge for operative insertion into a thermal printing device of the type having a cartridge receiving cavity and a print assembly comprising a thermal print head and a platen in which the print head and platen are movable toward and away from one another between print and non-print positions, respectively, said tape supply cartridge being free of any ink transfer ribbon and comprising:

a cartridge housing including first and second spaced, substantially parallel walls with peripheral edges and an edge wall joined to said first and second walls, said edge wall extending along a substantial portion of the peripheral edges of said first and second walls;

an advancement/lamination roller rotably mounted within said cartridge housing about an axis perpendicular to said first and second walls;

a supply spool of image receiving, direct thermal tape contained within said housing, said supply spool having a center and said thermal direct tape having a view side and an opposite substrate side and being wound onto said supply spool with said substrate side facing the center of said supply spool, said substrate side including a thermal sensitive coating capable of forming an image on said substrate side when exposed to heat generated by said thermal print head, said image receiving tape extending between said print head and said platen when the cartridge is operatively inserted into said cartridge receiving cavity, said image receiving tape further extending to said advancement/lamination roller and being oriented with its substrate side facing said advancement/lamination roller, said image receiving tape being transparent or translucent to permit the image formed on said substrate side to be viewed through said image receiving tape from said view side; and a spool of double sided adhesive tape having a first adhesive side with exposed adhesive, and a second adhesive side with a release liner covering the adhesive of said second adhesive side, said lamination tape extending to said advancement/lamination roller and being orientated so that said release liner side faces said advancement/lamination roller and is positioned between said advancement/lamination roller and said image receiving tape.

2. A tape supply cartridge for operative insertion into a thermal printing device having a thermal print head, said cartridge consisting essentially of:

a cartridge housing including first and second spaced, substantially parallel walls with peripheral edges and an edge wall joined and extending along a substantial portion of the peripheral edges of said first and second walls;

an advancement/lamination roller positioned between said first and second walls and rotatable about an axis perpendicular to said first and second walls;

a spool of lamination tape mounted within said cartridge housing and having an exposed adhesive side and a release liner side, said lamination tape extending to said advancement/lamination roller and being orientated so that said release liner side faces and engages a surface portion of said advancement/lamination roller; and a spool of image receiving tape mounted within said cartridge housing and having a view side and an opposite substrate side, said image receiving tape is transparent or translucent to permit the image formed on said substrate side to be viewed through said image receiving tape from said side view, said image receiving tape being a direct thermal image tape wherein said substrate side includes a thermal sensitive coating capable of forming an image on said substrate side when exposed to heat generated by said thermal print head, said image receiving tape being oriented so that it extends past said print head and to said advancement/lamination roller with said substrate side facing said print head and said advancement/lamination roller, said lamination tape positioned between said advancement/lamination roller and said image receiving tape.

* * * * *

UNITED STATES PATENT AND TRADEMARK OFFICE

CERTIFICATE OF CORRECTION

PATENT NO. : 6,190,065 B1
DATED : February 20, 2001
INVENTOR(S) : Brzuskiewicz

It is certified that error appears in the above-identified patent and that said Letters Patent is hereby corrected as shown below:

Column 3,
Line 33, reads "roller." should read -- roller 25. --

Signed and Sealed this

First Day of January, 2002

*Attest:*

*Attesting Officer*

JAMES E. ROGAN
*Director of the United States Patent and Trademark Office*